US006213785B1

(12) United States Patent
Nishio et al.

(10) Patent No.: US 6,213,785 B1
(45) Date of Patent: Apr. 10, 2001

(54) MEMORY CARD CONNECTOR

(75) Inventors: Atsushi Nishio, Nishiibaraki-Gun; Katsuhiro Hori, Mito; Kazuhiro Okazaki, Hitachinaka, all of (JP)

(73) Assignee: Mitsumi Electric Co., Ltd. (JP)

( * ) Notice: Subject to any disclaimer, the term of this patent is extended or adjusted under 35 U.S.C. 154(b) by 0 days.

(21) Appl. No.: 09/514,128

(22) Filed: Feb. 25, 2000

(30) Foreign Application Priority Data

Feb. 26, 1999 (JP) ..... 11-049248

(51) Int. Cl.[7] ..... H01R 12/00
(52) U.S. Cl. ..... 439/64; 439/108
(58) Field of Search ..... 439/62, 64, 92, 439/108, 159

(56) References Cited

U.S. PATENT DOCUMENTS 5,308,251 * 5/1994 Kaufman et al. ..... 438/64
5,511,986 * 4/1996 Casey et al. ..... 439/188
5,588,850 * 12/1996 Pan et al. ..... 439/92
5,653,596 * 8/1997 Banakis et al. ..... 439/64

* cited by examiner

*Primary Examiner*—Brian Sircus
*Assistant Examiner*—T. C. Patel
(74) *Attorney, Agent, or Firm*—Morrison Law Firm

(57) ABSTRACT

A T-shaped groove is cut out from a section of a guide wall of a memory card connector. The groove also defines an interior T-shaped portion. The bar portion of the interior T-shaped portion is bent back 180 degrees so that it extends over the groove from which it was cut out. The bar portion of the interior T-shaped portion makes contact with the edges of the groove preventing the interior T-shaped portion from moving through the groove. The interior T-shaped portion also has an arcuate portion that resiliently holds a memory card in place. The memory card connector also includes a connection part and at least one other guide wall arraigned to from a U-shaped slot for holding a memory card.

7 Claims, 4 Drawing Sheets

PRIOR ART

MEMORY CARD CONNECTOR

BACKGROUND TO THE INVENTION

As is known, memory cards are inserted into slots on personal computers and the like for exchanging recorded data with external devices. These slots include memory card connectors having connection pins that contact a plurality of contacts on the memory cards.

Referring to FIG. 5, a memory card connector (shown generally as 30) is formed with an electrical insulating resin. Memory card connector 30 is equipped with a connection part 2A, which supports a plurality of connection pins 1A. Connection pins 1A engage the contacts of a memory card MC.

A slot 32 is formed between a pair of guide walls 3A and 4A and bounded by connection part 2A. Memory card MC is inserted into slot 32. Guide walls 3A and 4A are formed in a unitary manner on both ends of connection part 2A. Memory card MC, is inserted into slot 32 and is guided towards connection part 2A by guide walls 3A and 4A.

Attachment slits 5A and 6A are formed toward the end of guide walls 3A and 4A. Any static electricity building up in memory card MC is discharged to a grounding conductor or the like on a substrate (not shown) by earth terminals 10A. Earth terminals 10A are joined to attachment slits 5A and 6A. Each earth terminal 10A is equipped with a terminal body 10*a* inserted into and supported by attachment slits 5A and 6A. A pressure spring 10*b* is unitary formed along an extension of terminal body 10*a*. An arc-shaped protrusion 10*c* of pressure spring 10*b* is in elastic contact with the side surface of memory card MC when memory card MC is inserted into slot 32. In addition, each earth terminal 10A has a grounding piece 10*d*, which is soldered onto the grounding conductor of a printed circuit board (not shown). Grounding piece 10D is formed by bending it at an approximate right angle to terminal body 10*a*.

Because pressure spring 10*b* is formed as an extension of terminal body 10*a*, earth terminal 10A must be sufficiently large to support pressure spring 10*b*. Not only is the overall size of the memory card connector increased, but also the end parts of guide walls 3A and 4A, to which earth terminals 10A are attached, have poor mechanical strength.

Referring to FIG. 6, a housing groove 11A and an interference preventing groove 12A are formed on both sides of attachment slits 5A and 6A. Housing groove 11A and interference preventing groove 12A work together to allow arc-shaped portion 10*c* to resiliently move as memory card MC is inserted into slot 32. A stopper 13A, which is formed at the end of housing groove 11A, restrains the end of pressure spring 10*b*. Because the above memory card connector 30 requires housing groove 11A and interference preventing groove 12A, the thickness of guide walls 3A and 4A is smaller in the region surrounding the grooves compared to other parts. When a strong outside force is applied to guide walls 3A and 4A, such as when memory card MC is inserted or removed, there is a possibility that guide walls 3A and 4A will deform or break.

Furthermore, because stopper 13A is necessary, a minimum thickness is required. Guide walls 3A and 4A can not be miniaturized beyond that point.

OBJECT AND SUMMARY OF THE PRESENT INVENTION

An object of the present invention is to provide a memory card connector with an earth terminal that is smaller in dimension than is possible in the prior art.

Another object of the present invention is to provide a memory card connector that does not have any regional weaknesses in the part of the guide walls where the earth terminal is located.

A further object of the present invention is to provide a memory card connector with smaller guide walls smaller than is possible in the prior art.

Briefly stated, the present invention provides a T-shaped groove cut out from a section of a guide wall of a memory card connector. The groove also defines an interior T-shaped portion. The bar portion of the interior T-shaped portion is bent back 180 degrees so that it extends over the groove from which it was cut out. The bar portion of the interior T-shaped portion makes contact with the edges of the groove preventing the interior T-shaped portion from moving through the groove. The interior T-shaped portion also has an arcuate portion that resiliently holds a memory card in place. The memory card connector also includes a connection part and at least one other guide wall arraigned to from a U-shaped slot for holding a memory card.

According to an embodiment of the present invention, there is provided a memory card connector comprising: a connection part; a first and second guide wall attached substantially perpendicular to both ends of the connection part whereby the first and second guide walls and the connection part define a u-shaped slot for holding a memory card; at least one terminal having a terminal body and a tab; at least one attachment slit on at least one of the first and second guide wall for fixing the at least one terminal to the at least one of the first and second wall; the tab for connecting to an external contact; a groove in the at least one terminal body; a T-shaped pressure spring resiliently disposed in the groove; the T-shaped pressure spring having an arcuate portion for making resilient contact with the memory card; the T-shaped pressure spring also having an end bent in a hairpin shape wherein the end is wider than the width of the groove; and the end engaging the groove whereby the end is restrained from passing through the groove.

According to another embodiment of the present invention, there is provided a memory card connector comprising: a connection part; a first and second guide wall attached substantially perpendicular to both ends of the connection part whereby the first and second guide walls and the connection part define a u-shaped slot for holding a memory card; at least one terminal having a terminal body and a tab; at least one attachment slit on at least one of the first and second guide wall for fixing the at least one terminal to the at least one of the first and second wall; the tab for connecting to an external contact; a T-shaped groove cut in the at least one terminal body; the groove also defining an interior T-shaped portion integrally connected at an end opposite a bar portion of the interior T-shaped interior portion to the at least one terminal body; the interior T-shaped interior portion has an arcuate portion for making resilient contact with the memory card; a hairpin bend in the bar portion of the interior T-shaped interior portion wherein the bar portion is bent back 180 degrees until the bar portion extends over an upright portion of the groove; and the bar portion engaging the groove whereby the bar portion is restrained from passing through the groove.

In order to achieve these objects, the present invention proposes a memory card connector, the memory card connector having a connection part, which has a pair of guide walls formed in a unitary manner on both ends to form a slot into which a memory card can be inserted, and an earth terminal, which discharges static electricity of the memory card and is supported by attachment slits on the guide walls so that there is pressure contact with the memory card, wherein: the earth terminal is equipped with a grounding piece, which is soldered onto a grounding conductor and is bent at approximately right angle from a terminal body which is inserted into the attachment slits, and a pressure spring which has been cut and offset in a cantilever manner by a cutting groove on a surface of the terminal body and whose end is bent back in a hairpin shape; an end protrusion part of the pressure spring is restrained by a latching surface constructed from a surface of the terminal body.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
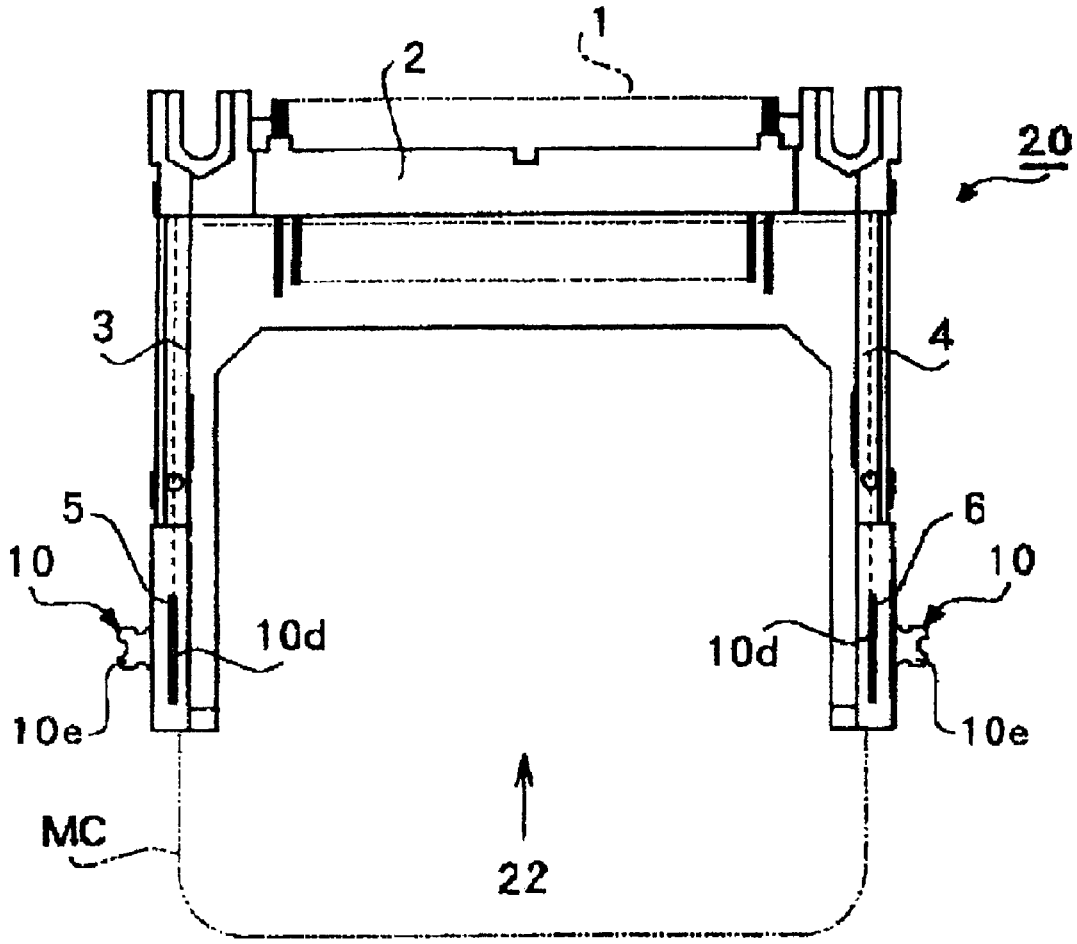
FIG. 1 is a whole plan view of the memory card connector of the present invention.
Figure 2:
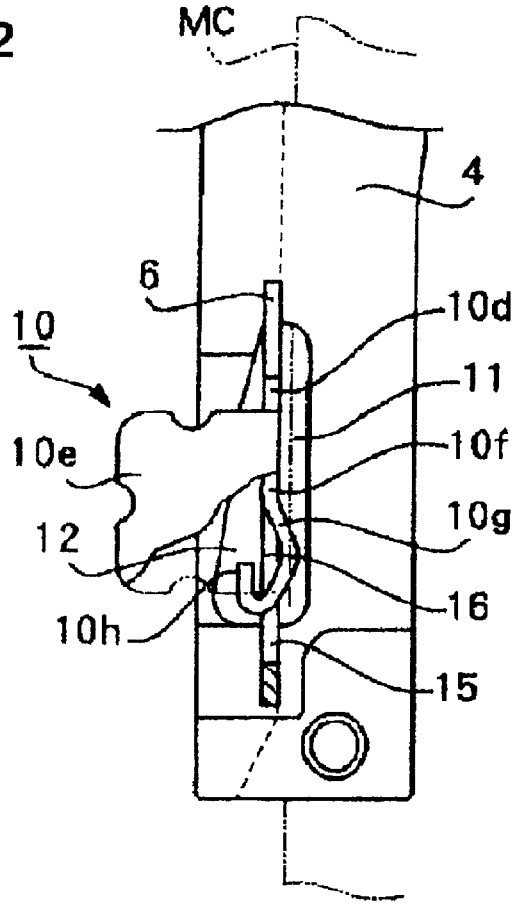
FIG. 2 is an enlarged rear view of the essential part of the memory card connector which is shown reversed.
Figure 3:
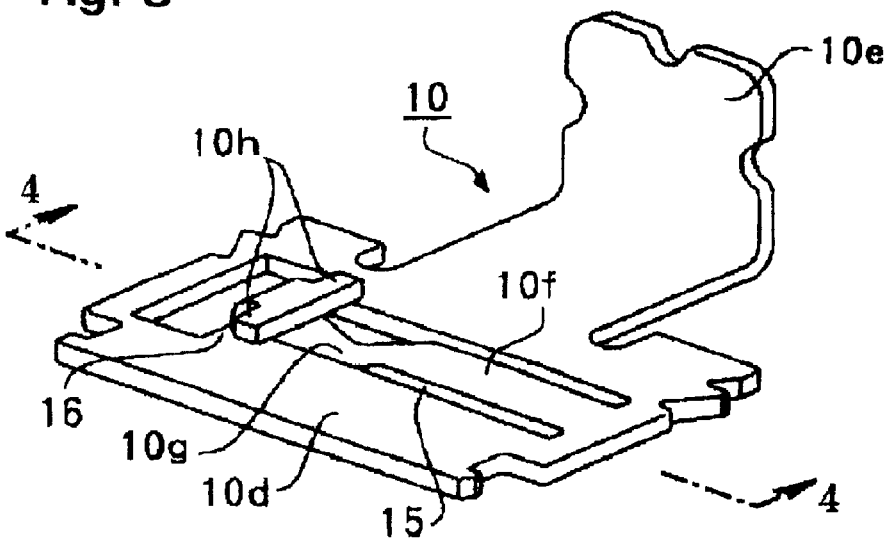
FIG. 3 is an enlarged perspective view of the earth terminal used in the memory card connector.
Figure 4:
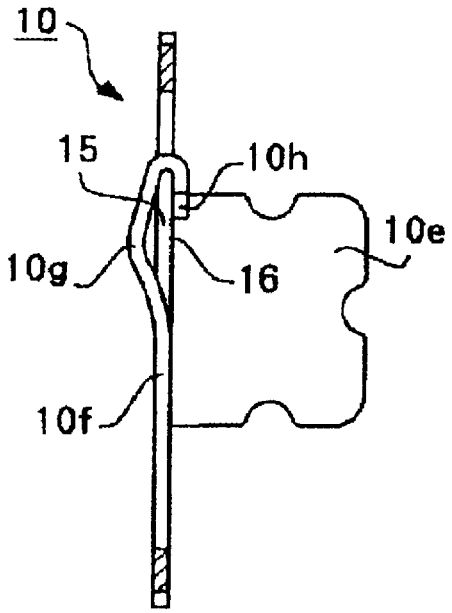
FIG. 4 is a cross-section drawing along line 4—4 of the earth terminal of FIG. 3.
Figure 5:
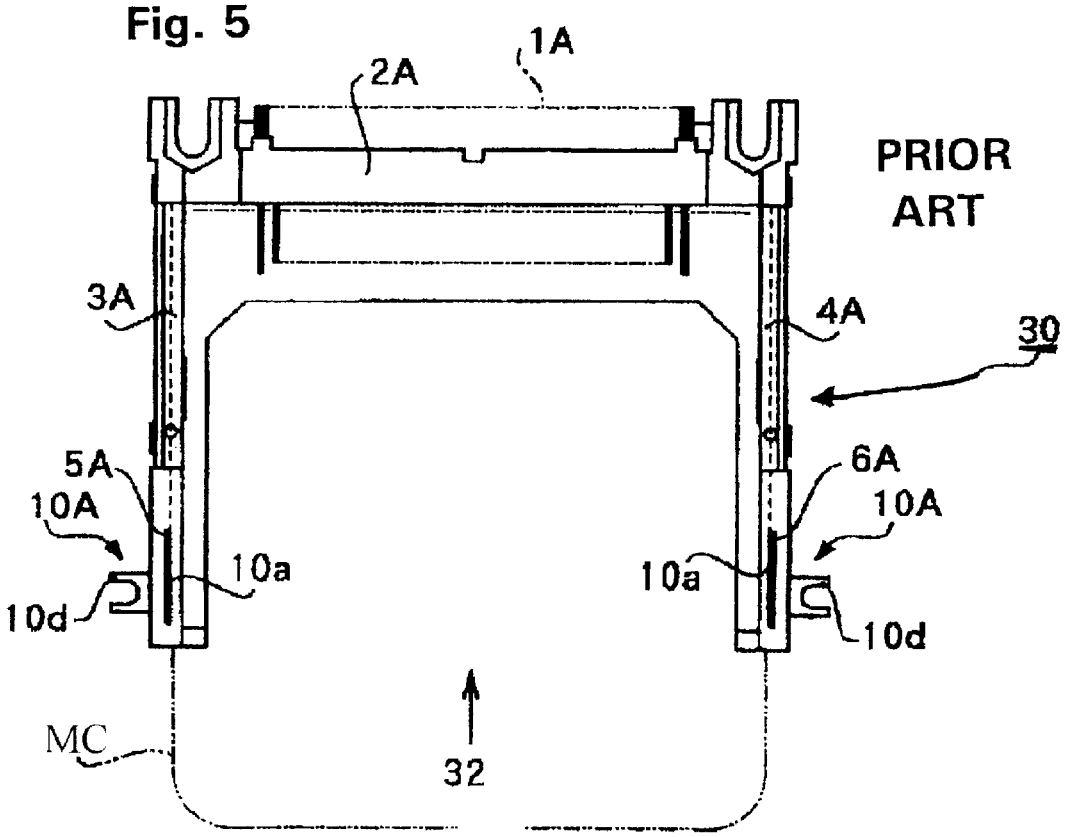
FIG. 5 is a whole plan view of a memory card connector of the prior art.
Figure 6:
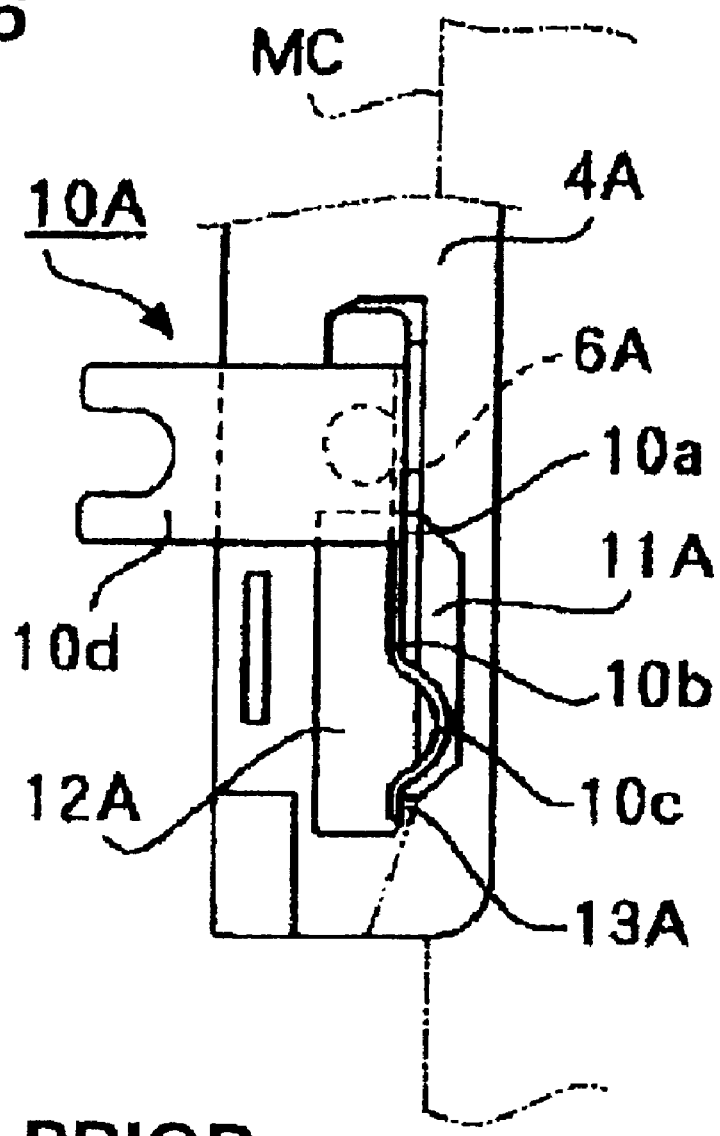
FIG. 6 is an enlarged rear view of the essential part of the memory card connector which is shown reversed.

Referring to FIGS. 1 through 4, a memory card connector (shown generally as 20) is formed of an electrical insulating resin. A connection part 2 supports a plurality of connection pins 1 each contacting a respective connector in a memory card MC. A slot 22 is formed by a pair of guide walls 3 and 4 joined with connection part 2. Memory card MC is inserted into slot 22. Guide walls 3 and 4 are formed in a unitary manner on both ends of connection part 2. Memory card MC is guided towards connection part 2 by guide walls 3 and 4 as it is inserted into slot 22.

Attachment slits 5 and 6 are formed towards the end of guide walls 3 and 4. Any static electricity present in memory card MC is discharged to a grounding conductor or the like (not shown) by earth terminals 10 which are attached to attachment slits 5 and 6.

Each earth terminal 10 is equipped with a rectangular plate-shaped terminal body 10*d*, which is inserted into attachment slits 5 and 6. On one side of terminal body 10*d*, a grounding piece 10*e* (which is soldered onto a grounding conductor on a printed circuit board for example), is bent at an approximately right angle.

In addition, on the surface of terminal body 10*d*, a T-shaped pressure spring 10*f* is cut and offset in a cantilever manner by a cutting groove 15. The end of pressure spring 10*f* is bent into a hairpin-shape. In the middle section in the longitudinal direction, pressure spring 10*f* is bent into a hill shape to form a contact protrusion 10*g*. Contact protrusion 10*g* is bent towards the side surface of memory card MC, which is inserted into slot 22. Because contact protrusion 10*g* is in elastic contact with the side surface of memory card MC, the static electricity of memory card MC is discharged to earth terminal 10.

End protrusion parts 10*h*, which forms the top of the T-shape, are formed on both sides of the end of pressure spring 10*f*, which has been bent into a hairpin shape. End protrusion parts 10*h* are placed on the opposite side of the slot and are hooked onto a latching surface 16.

Therefore, when memory card MC is not present in the slot, contact protrusion 10*g* moves towards the slot by the restoring force of pressure spring 10*f*. However, because the latching of end protrusion part 10*h* makes contact with latching surface 16, anomalous movement of contact protrusion 10*g* is prevented.

According to the embodiment shown, pressure spring 10*f* is bent into a hairpin shape and contact protrusion 10*g* of pressure spring 10*f* contacts the side surface of memory card MC when inserted into slot 22. As a result, housing groove 11 and interference preventing groove 12, which are formed on both sides of the attachment slits, can be made very small. The thickness of the guide walls to which earth terminals 10 are attached is regionally increased by the amount that is reduced by the groove widths of housing groove 11 and interference preventing groove 12. In this way, the mechanical strength of this section is maintained throughout.

In addition, earth terminal 10 includes grounding piece 10*e* which is bent at a right angle to terminal body 10*d* and from which pressure spring 10*f* is cut and offset. This results in an overall reduction the size of memory card connector 20. Additionally, because the present invention does not include a stopper 13A (as is required in the prior art), the thickness of guide walls 3 and 4 can be reduced.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A memory card connector comprising:

a connection part;

first and second guide walls attached substantially perpendicular to both ends of said connection part whereby said first and second guide walls and said connection part define a u-shaped slot for holding a memory card;

at least one terminal having a terminal body and a tab;

at least one attachment slit on at least one of said first and second guide walls for fixing said at least one terminal to said at least one of said first and second walls;

said tab for connecting to an external contact;

a groove in said at least one terminal body;

a T-shaped pressure spring resiliently disposed in said groove;

said T-shaped pressure spring having an arcuate portion for making resilient contact with said memory card;

said T-shaped pressure spring also having an end bent in a hairpin shape wherein said end is wider than the width of said groove; and said end engaging said groove whereby said end is restrained from passing through said groove.

2. A memory card connector as in claim 1 wherein said tab is adapted to be fixed to a printed circuit board.

3. A memory card connector as in claim 1 wherein said tab is bent at substantially a right angle with respect to said terminal body.

4. A memory card connector as in claim 1 wherein said tab is connected to an earth terminal for discharging static electricity in said memory card.

5. A memory card connector as in claim 1 wherein said connection part includes a plurality of connecting elements for connecting said memory card to an electronic device.

6. A memory card connector as in claim 1 wherein said connection part and said first and second guide walls are made of an electrically insulating resin.

7. A memory card connector comprising:

a connection part;

a first and second guide wall attached substantially perpendicular to both ends of said connection part whereby said first and second guide walls and said connection part define a u-shaped slot for holding a memory card;

at least one terminal having a terminal body and a tab;

at least one attachment slit on at least one of said first and second guide walls for fixing said at least one terminal to said at least one of said first and second walls;

said tab for connecting to an external contact;

a T-shaped groove cut in said at least one terminal body;

said groove also defining an interior T-shaped portion integrally connected at an end opposite a bar portion of said interior T-shaped interior portion to said at least one terminal body;

said interior T-shaped interior portion has an arcuate portion for making resilient contact with said memory card;

a hairpin bend in said bar portion of said interior T-shaped interior portion wherein said bar portion is bent back 180 degrees until said bar portion extends over an upright portion of said groove; and said bar portion engaging said groove whereby said bar portion is restrained from passing through said groove.

* * * * *